US009320359B2

(12) United States Patent
Lu

(10) Patent No.: US 9,320,359 B2
(45) Date of Patent: Apr. 26, 2016

(54) BACKREST TRANSLATION MECHANISM

(71) Applicant: Dongguan Weihong Hardware and Plastic Products Co., Ltd., Dongguan (CN)

(72) Inventor: Wei Lu, Dongguan (CN)

(73) Assignee: DONGGUAN WEIHONG HARDWARE AND PLASTIC PRODUCTS CO., LTD., Dongguan, Guangdong (CN)

( * ) Notice: Subject to any disclaimer, the term of this patent is extended or adjusted under 35 U.S.C. 154(b) by 68 days.

(21) Appl. No.: 14/190,613

(22) Filed: Feb. 26, 2014

(65) Prior Publication Data

US 2015/0196122 A1 Jul. 16, 2015

(30) Foreign Application Priority Data

Jan. 10, 2014 (CN) ..... 2014 1 0012199

(51) Int. Cl.

| | |
|---|---|
| ***A47C 1/026*** | (2006.01) |
| ***A47C 1/023*** | (2006.01) |
| ***A47C 7/40*** | (2006.01) |
| ***A47C 17/04*** | (2006.01) |

(52) U.S. Cl.

CPC ..... *A47C 1/026* (2013.01); *A47C 1/023* (2013.01); *A47C 7/40* (2013.01); *A47C 17/04* (2013.01)

(58) Field of Classification Search

CPC ..... A47C 1/026; A47C 1/023; A47C 7/40; A47C 17/04

USPC ..... 297/343, 353, 366, 383, 94

See application file for complete search history.

(56) References Cited

U.S. PATENT DOCUMENTS

| | | | | | |
|---|---|---|---|---|---|
| 5,286,088 | A * | 2/1994 | Taylor et al. | ..... | 297/353 |
| 5,649,741 | A * | 7/1997 | Beggs | ..... | 297/353 |
| 5,775,776 | A * | 7/1998 | Schooler et al. | ..... | 297/375 |
| 5,806,877 | A * | 9/1998 | Huang | ..... | 280/642 |
| 5,839,784 | A * | 11/1998 | Breen | ..... | 297/383 |
| 5,902,013 | A * | 5/1999 | Hong | ..... | 297/383 |
| 6,767,053 | B1 * | 7/2004 | Crounse | ..... | 297/215.12 |
| 7,364,238 | B2 * | 4/2008 | Higgs et al. | ..... | 297/383 |
| 7,387,338 | B2 * | 6/2008 | Beranek et al. | ..... | 297/283.3 |

* cited by examiner

*Primary Examiner* — Charles A Fox
*Assistant Examiner* — Christopher e Veraa
(74) *Attorney, Agent, or Firm* — Shimokaji IP

(57) ABSTRACT

A backrest translation mechanism includes a holder mounted on a sofa seat, a swing locating member, a backrest mount, a slider, and a positioning pin. The swing locating member has a first end pivoted on the holder, several locking slots with downward openings arranged at regular intervals along its length direction. The locking slots are adapted for engaging with and unidirectionally locking up the positioning pin, one side of each locking slots is provided with an inclined surface inclined towards an opposite direction of the first end. The slider is slidably set on the swing locating member and has a retaining slot and a limiting slot. The positioning pin is accepted by the retaining slot and the locking slot jointly, and the positioning pin is restricted to be out of the locking slot by the limiting slot. The mechanism has multiple using positions for adjusting the translation of the backrest.

9 Claims, 8 Drawing Sheets

BACKREST TRANSLATION MECHANISM

FIELD OF THE INVENTION

The present invention relates to a component of a sofa, more particularly to a backrest translation mechanism that is able to adjust the translation movement of a backrest of the sofa.

BACKGROUND OF THE INVENTION

Conventionally, a backrest of a sofa is fixed on a sofa seat, as a result, the room defined by the backrest and the sofa seat and supplying for people seating is constant. Thus not every consumer with different ages may obtain a comfortable feeling when seating on such a sofa, due to their different physiques. In addition, this old sofa has only function for seating, which can not meet various demands of the consumers.

For improving the drawbacks mentioned above, some improved sofas for reclining or lying are developed. An adjuster is added to the sofa for adjusting angles and positions of the headrest or backrest, so that the using mode of the sofa could be changed.

In prior art, an adjuster for adjusting positions of the backrest is a linkage which has one end fixed on the backrest and the other end fixed on the sofa seat, so as to twist a parallelogram to move the backrest forwards or backwards. However, the linkage has some drawbacks as follows. First, due to the restriction of a parallelogram structure, the movement route during the adjusting of the backrest is an arc, but not a straight line (that is the movement is not a pure translation movement), which causes the adjusting to be inconvenient. Besides, the linkage must sustain the whole weight of the backrest, which may damage the backrest. Second, only two using positions (one forward and one backward) are provided to be adjusted, which also could not meet the demand of various using positions.

Therefore, it's a need to provide a backrest translation mechanism with multiple using positions for adjusting the translation movement of the backrest.

SUMMARY OF THE INVENTION

One objective of the present invention is to provide a backrest translation mechanism with multiple using positions for adjusting the translation movement of the backrest.

To achieve the above objective, a backrest translation mechanism, used for adjusting positions of a backrest relative to a sofa seat, includes a holder, a swing locating member, a backrest mount, a slider, and a positioning pin. Specifically, the holder is mounted on the sofa seat, the swing locating member is shaped as a strip whose one end is defined as a first end pivoted on the holder, and the swing locating member has several locking slots with downward openings arranged at regular intervals along a length direction of the swing locating member, the locking slots are adapted for engaging with and unidirectionally locking up the positioning pin by gravity, one side, far from the first end, of each locking slot is provided with an inclined surface which is inclined towards an opposite direction of the first end. The backrest mount has an upper end mounted on the backrest and a lower end slidably set on the holder along the length direction. The slider is slidably set on the swing locating member along the length direction, and the slider has a retaining slot and a limiting slot both of which extends along the length direction and penetrates through the slider. The positioning pin is accepted by the retaining slot and the locking slot jointly, the limiting slot is located on one side of the retaining slot that closes to the first end and communicated with the retaining slot, and the positioning pin is restricted to be out of the locking slot by the limiting slot. The positioning pin is fixed on the lower end of the backrest mount and slidably inserted into the retaining slot and the limiting slot.

In comparison with the prior art, since the backrest is mounted on the upper end of the backrest mount, and the holder fixed on the sofa seat is mounted on the lower end of the backrest mount, thus the backrest is capable of translating or move horizontally along the length direction when the backrest is adjusted, which the operation is very simple. Furthermore, the weight of the backrest is sustained by the sofa seat during the translation movement, but not by the backrest translation mechanism, which prevents the backrest translation mechanism 1 being damaged. Meanwhile, due to multiple locking slots are set on the swing locating member, thus the backrest mount could be locked in different positions by engagement between the positioning pin and the locking slots, that is the backrest has multiple using positions which meets different demands of consumers.

Preferably, the retaining slot and the limiting slot have a common lower wall, an upper wall of the limiting slot is lower than a position of the opening of the locking slot, and an upper wall of the retaining slot is higher than that of the limiting slot. Due to the upper wall of the limiting slot is lower than the position of the opening of the locking slot, thus the slider could not slide when the positioning pin 1 is restricted in the limiting slot, so that the swing locating member can not engage with the positioning pin by gravity, which causes the backrest mount can make reciprocating adjustments freely.

Preferably, a long groove is formed through the swing locating member along the length direction and adapted for slidably receiving the positioning pin, and the locking slots are formed on an upper wall of the long groove.

Preferably, each locking slot has a cambered surface at one side that closes to the first end, and the cambered surface is abutting on the inclined surface and has a shape corresponding with an external profile of the positioning pin. As a result, the positioning pin can be locked in the locking slot in a single direction more stably due to the existence of the cambered surface, so that a reciprocating movement of the backrest mount can be restricted, to keep a stable using status.

Preferably, a spring leaf is set between the swing locating member and the slider, which is outwards urging on the slider. Due to this spring leaf, the slider will slide on the swing locating member only if the positioning pin is driven, which ensures the stability of the positional relationships among the retaining slot, the limiting slot and the positioning pin so as to keep the normal locking and normal sliding of the backrest mount.

Preferably, the holder comprises at least one guide roller, and at least one sleeve is formed at the lower end of the backrest mount for allowing the guide roller to pass through. The cooperation between the guide roller and the sleeve can achieve the slide of the backrest mount on the holder.

Preferably, two limiting plates standing vertically are provided at two sides of the holder, and the guide roller is set between the limiting plates. As a result, the sliding of the sliding mount 121 is prevented to going beyond the guide rollers.

Preferably, two guide rollers are provided at two sides of the holder respectively, and the guide rollers are symmetrical with the swing locating member.

Preferably, the lower end of the backrest mount is a provided with a sliding mount, two sides of the sliding mount are provided with two sleeves, and a middle of the sliding mount is provided with an opening for allowing the swing locating member and the slider to pass through.

More preferably, two pin fasteners extending downwards are fixed on a bottom of the sliding mount, which are located at two sides of the slider and form a passageway for allowing the positioning pin to pass through and then connect firmly.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
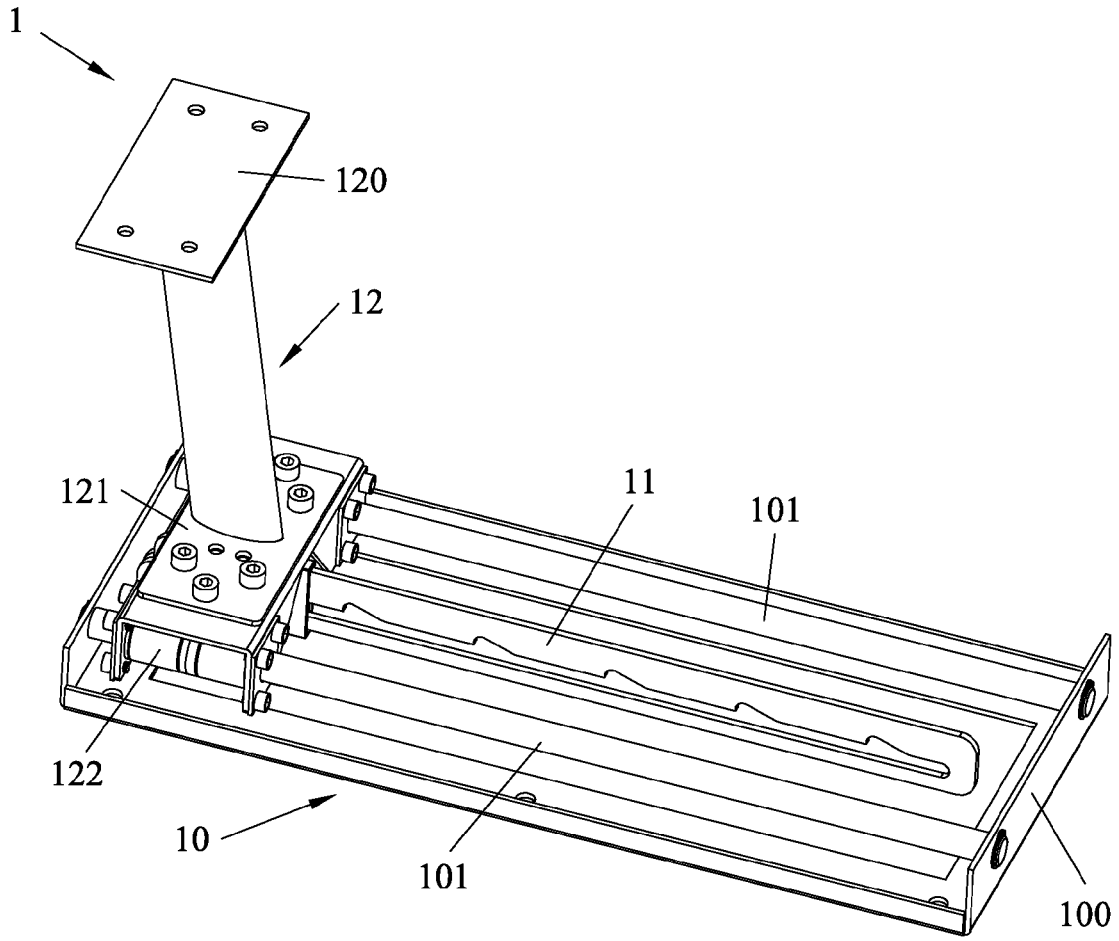
FIG. 1 is a perspective view of a backrest translation mechanism according to one embodiment of the present invention.
Figure 2:
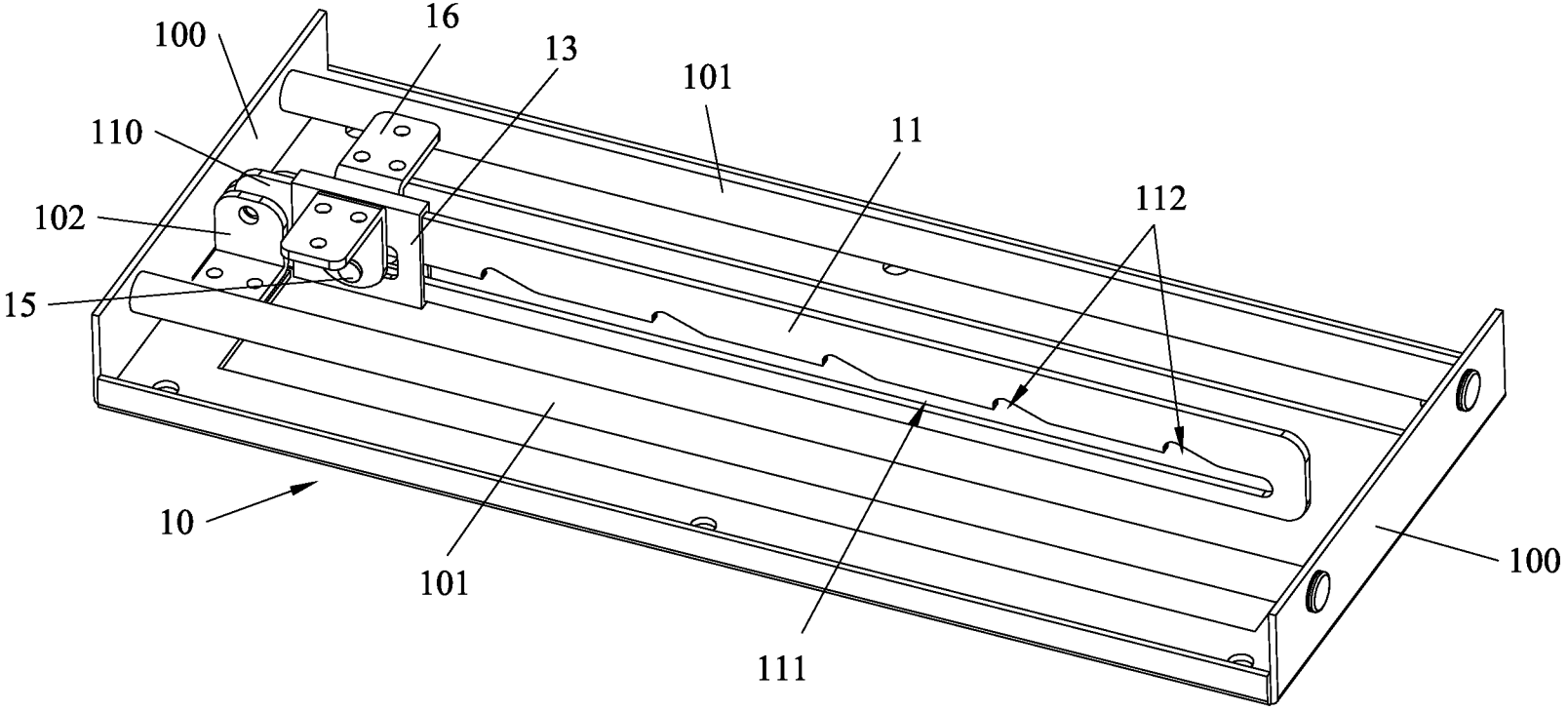
FIG. 2 is a perspective view of a backrest translation mechanism that omits a backrest mount according to one embodiment of the present invention.
Figure 3:
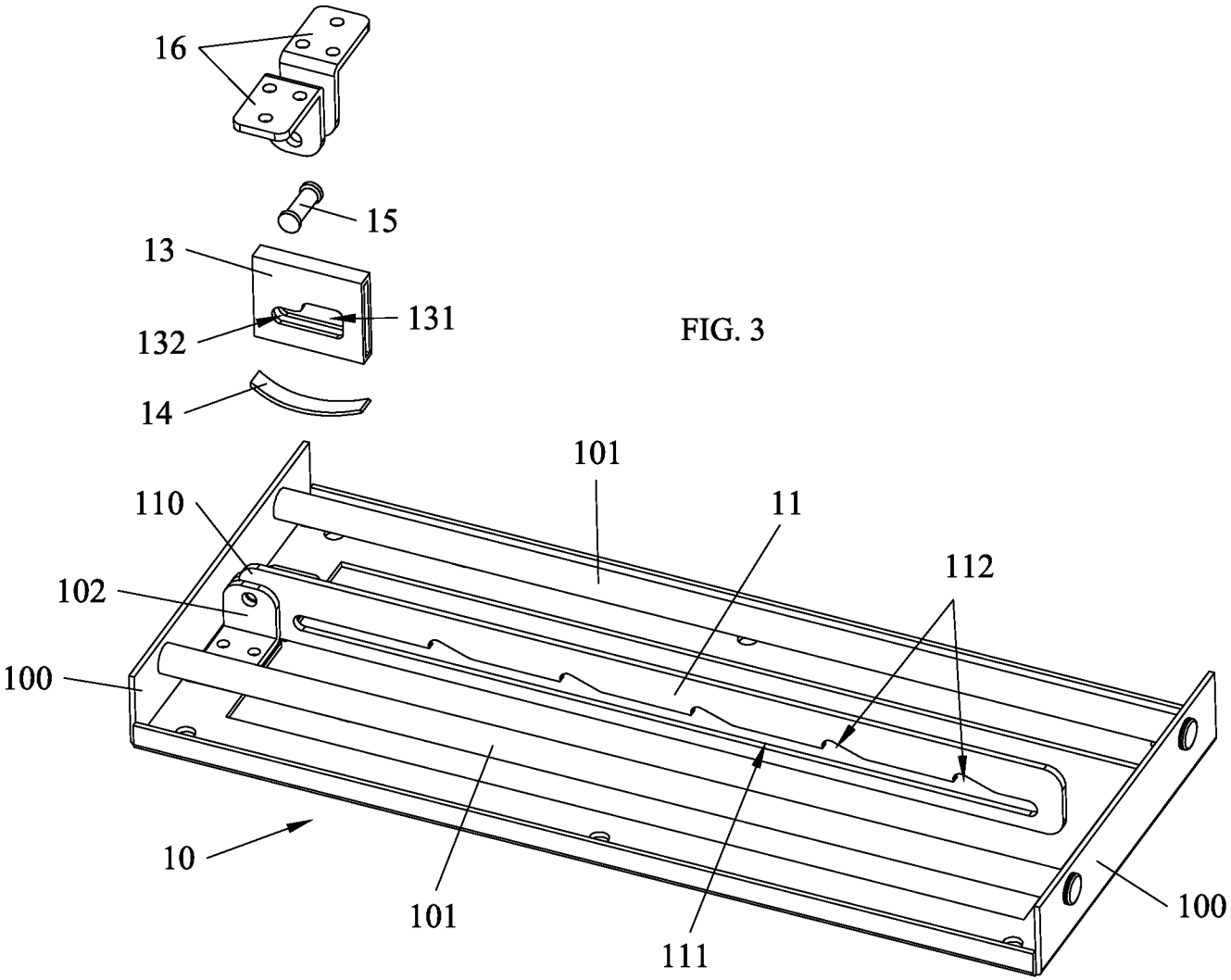
FIG. 3 is an exploded view of a backrest translation mechanism that omits a backrest mount according to one embodiment of the present invention.

As illustrated in FIGS. 1 to 3, the backrest translation mechanism 1 of the present embodiment includes a holder 10, a swing locating member 11, a backrest mount 12, a slider 13, and a positioning pin 15.

The holder 10 is shaped as a rectangle having a central opening, and the holder 10 has two long edges and two short edges. Two limiting plates 100 standing vertically are formed at two ends of the long edge of the holder 10, and two guide rollers 101 are set between the two limiting plates 100 along the direction of the long edges, so as to enhance the stability of the backrest translation mechanism 1 during adjusting and using. Further, a pivotal base 102 protruded upwards is fixed on one end of the holder 10, which is located at the middle position of the two guide rollers 101. The holder 10 of the present invention could be mounted on sofa seats or other seats.

The swing locating member 11 is shaped as a strip whose one end is defined as a first end 110 that is pivotally connected with the pivotal base 102, and a pivotal axis (not labeled) is set horizontally and vertical with a length direction of the swing locating member 11, by which the swing locating member 11 can be pivoted about the pivotal axis so that it can swing up and down relatively to the holder 10. The swing locating member 11 is located between the two guide rollers 101 which are symmetrical relatively to the swing locating member 11. A long groove 111 is formed on and running through the swing locating member 11 and extended along the length direction, which is used for accommodating the positioning pin 15 by sliding. Several locking slots 112 with downward openings are formed on the upper walls of the long groove 111. Concretely, each locking slot 112 has a cambered surface 113 formed on one side that closes to the first end 110, and an inclined surface 114 formed on another side far from the first end 110. Furthermore, the inclined surface 114 is inclined from up to down along a direction far from the first end (namely towards an opposite direction of the first end), the cambered surface 113 and the inclined surface 114 are abutted each other, and the cambered surface 113 has a shape corresponding with the external profile of the positioning pin 15. The positioning pin 15 is engaged with and unidirectionally locked by the locking slots 112 by gravity of the locking slots 112. Furthermore, the positioning pin 15 can be locked in the locking slot 112 in a single direction more stably due to the existence of the cambered surface 113, so that a reciprocating movement of the backrest mount 12 can be restricted, to keep a stable using status. In addition, the configuration of the inclined surface 114 ensures that the positioning pin 15 can slide from the locking slot 112 along the inclined surface 114, which keep a normal positive movement of the backrest mount 12.

The slider 13 defines a cavity in the middle where the swing locating member 11 passes through, so that the slider 13 can be slid on the swing locating member 11. A retaining slot 131 and a limiting slot 132 are formed on and run through the slider 13 along the length direction, and the positioning pin 15 is received by the retaining slot 131 and the locking slot 112 jointly. Specifically, the limiting slot 132 is located on one side of the retaining slot 131 near the first end and communicated with the retaining slot 131, and the positioning pin 15 is restricted to be out of the locking slot 112 by the limiting slot 132. More specifically, the retaining slot 131 and the limiting slot 132 have a common lower wall, an upper wall of the limiting slot 132 is lower than a position of the opening of the locking slot 112, and an upper wall of the retaining slot 131 is higher than that of the limiting slot 132 and has the same height position with the top of the locking slot 112. Due to the upper wall of the limiting slot 132 is lower than the position of the opening of the locking slot 112, thus the slider 13 could not slide when the positioning pin 15 is restricted in the limiting slot 132, so that the swing locating member 11 can not engage with the positioning pin 15 by gravity, which causes the backrest mount 12 can make reciprocating adjustments freely.

Furthermore, to enhance a tight relationship between the slider 13 and the swing locating member 11, a spring leaf 14 is set between the slider 13 and the swing locating member 11. Due to this spring leaf 14, the slider 13 will slide on the swing locating member 11 only if the positioning pin 15 is driven, which ensures the stability of the positional relationships among the retaining slot 131, the limiting slot 132 and the positioning pin 15 so as to keep the normal locking and normal sliding of the backrest mount 12. Of course, the spring leaf 14 can be omitted, and the tight relationship also can be achieved by replaced the spring leaf 14 with ribs formed on the swing locating member 11 and the slider 13 respectively, or by one way of interference fit.

The upper end of the backrest mount 12 is provided with a backrest mounting plate 120 which is fixed on a backrest of a sofa or other seats. The backrest mount 12 further has a lower end where a sliding mount 121 is connected. Two sleeves 122 are respectively set at two sides of the sliding mount 121, and the guide rollers 101 are passing through the sleeves 122, so that the backrest mount 12 can slide on the holder 10. While the two limiting plates 100 mentioned above are used for preventing the sliding of the sliding mount 121 beyond the guide rollers 101. Further, the sliding mount 121 has a middle opening (not labeled) for allowing the swing locating member 11 and the slider 13 to pass.

The sliding mount 121 further includes two pin fasteners 16 fixed on the bottom and extended downwards. Specifically, the pin fasteners 16 are respectively located at two sides of the slider 13, and a passageway is formed between the two pin fastener 16 for allowing the positioning pin 15 to pass and connect firmly.

As shown, the positioning pin 15 is fixed on the pin fasteners 16 and inserted into the long groove 111, the retaining slot 131 and the limiting slot 132.

Now referring to FIGS. 4 to 7, the adjusting process and the principle of the backrest translation mechanism 1 of the present invention follow.

Figure 4:
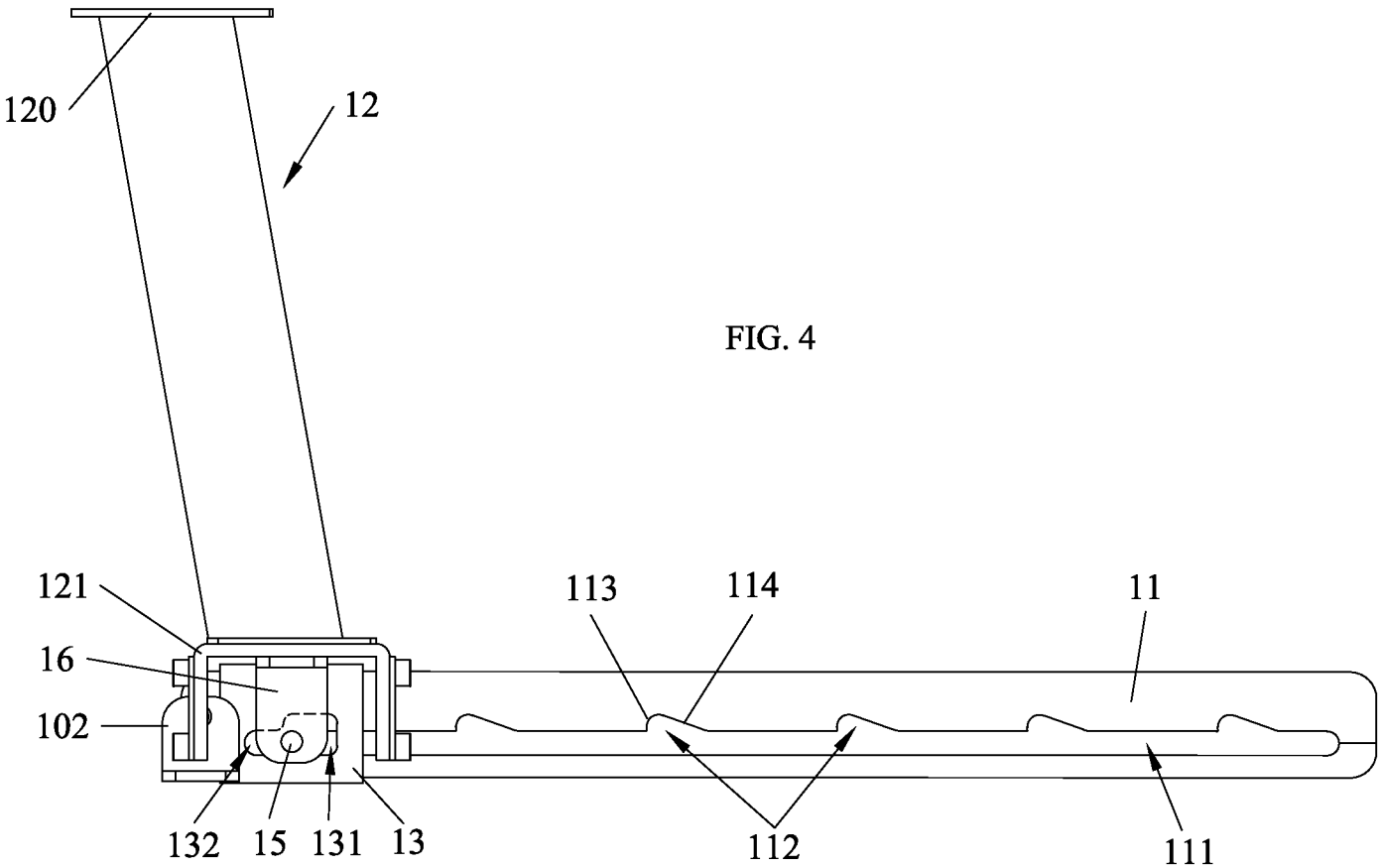
FIG. 4 is side view of a backrest translation mechanism that omits partial components according to one embodiment of the present invention.

FIG. 4 shows an initial position of the backrest mount 12 of the backrest translation mechanism 1. When the backrest is needed to adjust, the backrest is moved rightwards, namely the backrest mount 12 is moved rightwards, this moment, the positioning pin 15 fixed on the pin fasteners 16 slides rightwards along the swing locating member 11 by following the sliding mount 121, at the same time the slider 13 is driven to slide along the swing locating member 11 as the positioning pin 15 is urging the lower side wall of the retaining slot 131. During the slide, as the positioning pin 15 is interfered on the upper wall of the long groove 111, thus the position of the swing locating member 11 is steady.

Figure 5:
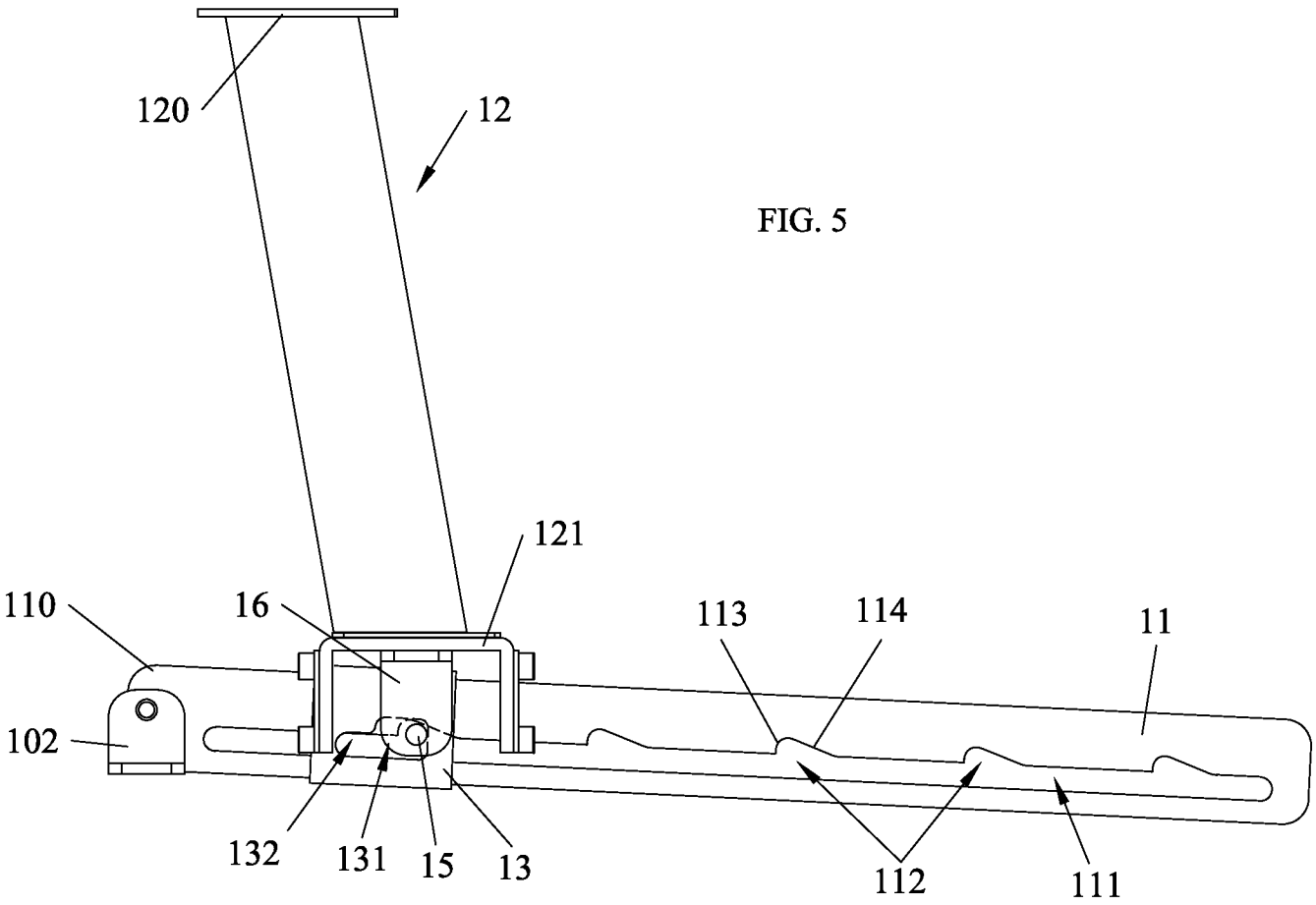
FIG. 5 is a side view of the backrest translation mechanism shown in FIG. 4 that the positioning pin is engaged with the locking slot.

As shown in FIG. 5, when the positioning pin 15 is slid beneath the first said locking slot 112, the swing locating member 11 will swing downwards about the pivotal axis of the first end 110 and the pivotal base 102 due to its gravity, as a result, the positioning pin 15 will be locked in the locking slot 112, and the slider 13 on the swing locating member 11 will also swing and slide, finally the positioning pin 15 will be received by the locking slot 112 and the upper portion of the retaining slot 131 jointly. Because of the restriction of the cambered surface 113, the positioning pin 15 is locked by the locking slot 112 in a single direction, but not a reverse direction (namely the left direction). Furthermore, because of the inclined surface 114, when the sliding mount 121 continues to move rightwards, the swing locating member 11 will be driven to swing upwards because the inclined surface 114 is urging on the positioning pin 15, so as to disengage from the locking slot 112, and in turns to move rightwards to reach different locking slots 112.

Figure 6:
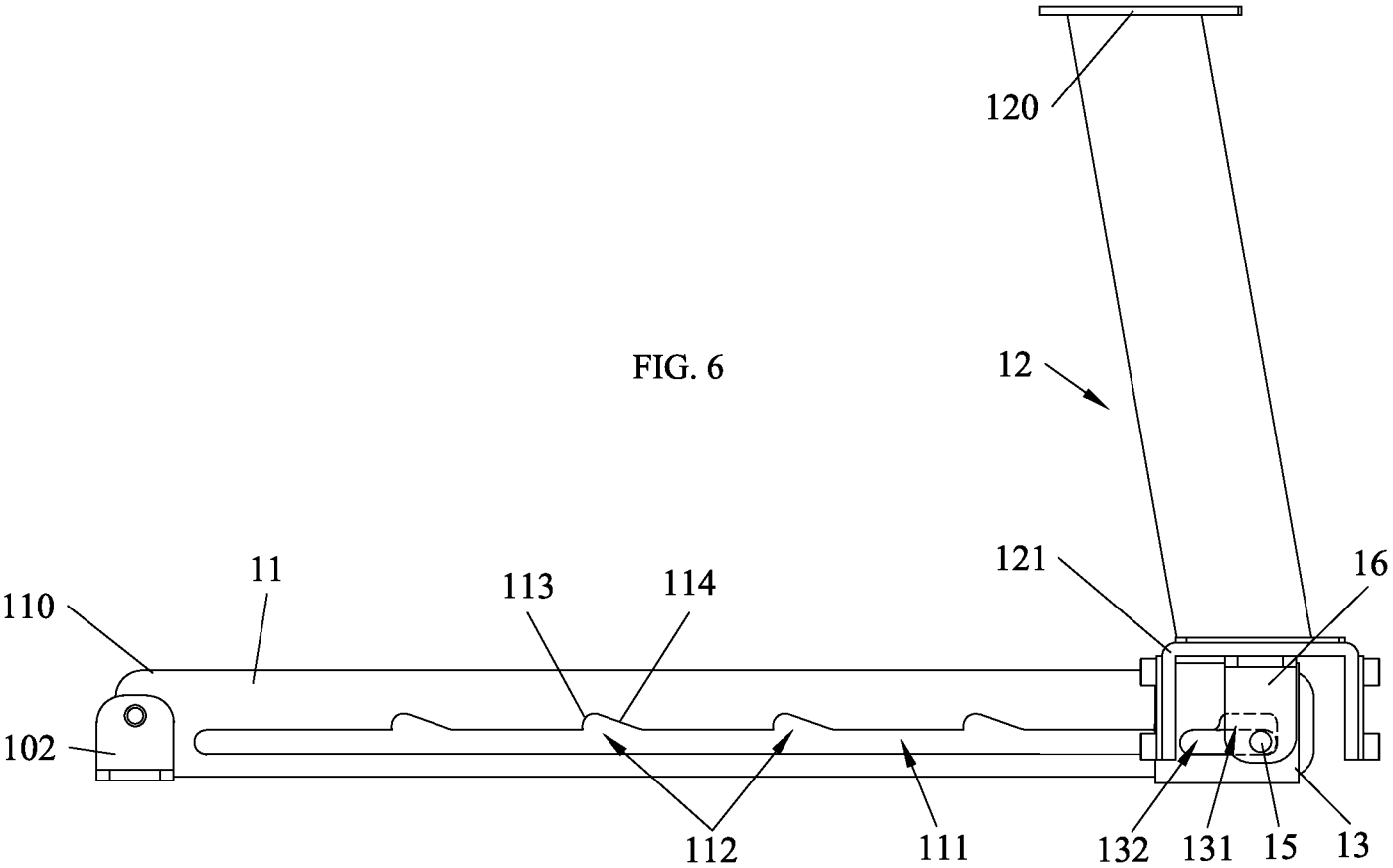
FIG. 6 is a side view of the backrest translation mechanism shown in FIG. 4 that the backrest mount is slid to the end.
Figure 7:
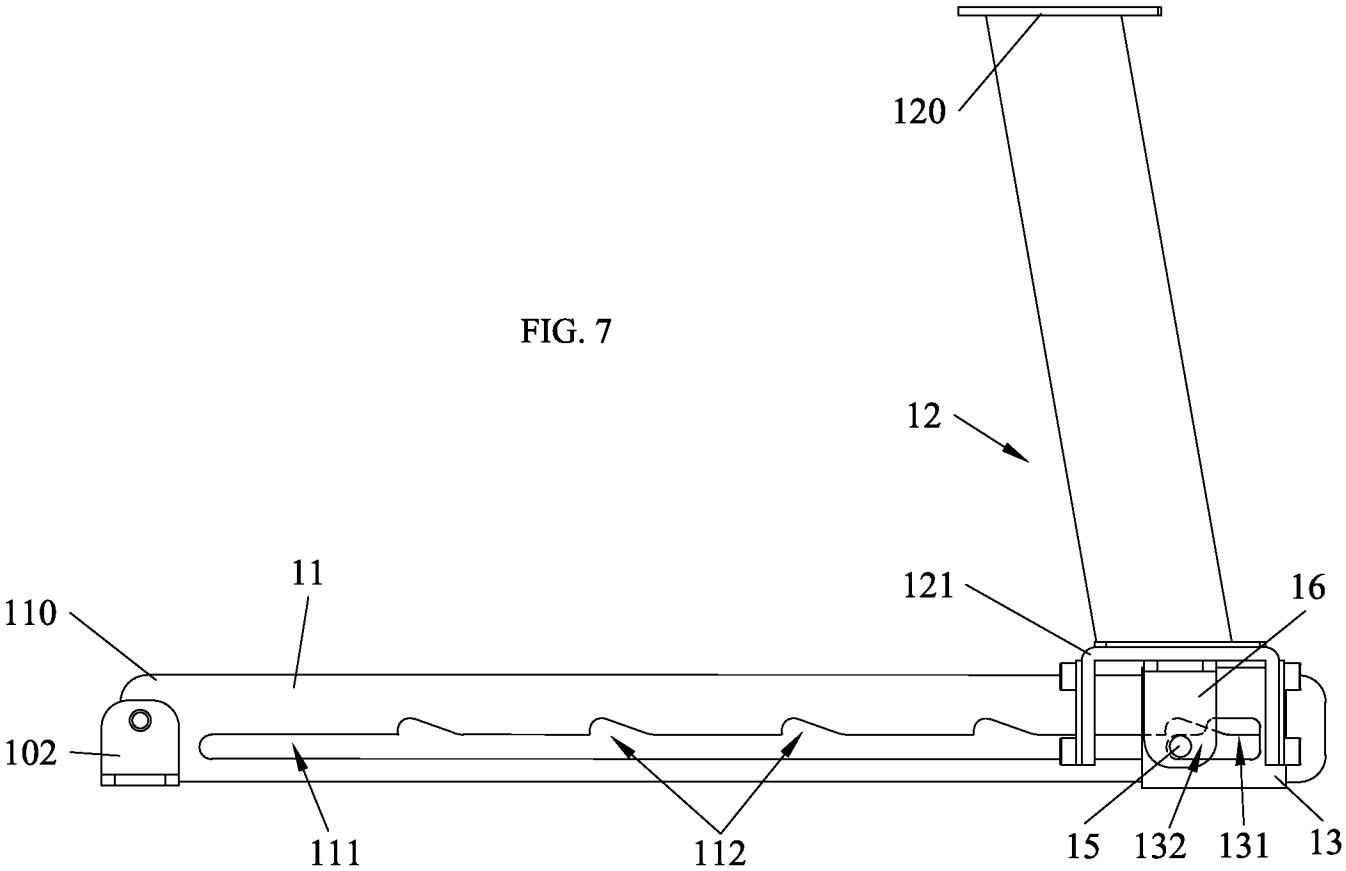
FIG. 7 is a side view of the backrest translation mechanism shown in FIG. 4 that the backrest mount is slid back.

Referring to FIGS. 6 and 7, when the backrest is needed to adjust reversely, the backrest mount 12 is moved leftwards, so that the positioning pin 15 is slid to engage with the limiting slot 132 and then the slider 13 is driven to slide on the swing locating member 11 by the positioning pin 15 urging against the left wall of the limiting slot 132. This moment, it's the one possibility for the slider 13 to slide along the length direction as it is restricted by the positioning pin 15, as a result the swing locating member 11 also is restricted which could not swing or pivot about the pivotal axis. Therefore, now the positioning pin 15 may not be locked by the locking slot 112, so that the backrest mount 12 can continue to move leftwards to reach a certain slot and then be locked by sliding rightwards.

Figure 8:
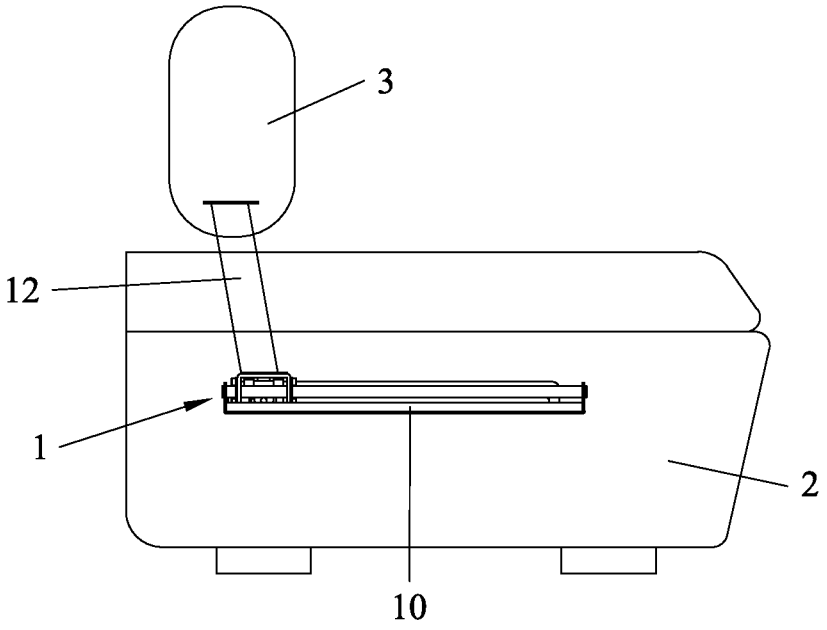
FIG. 8 is a status schematic view illustrating that the backrest translation mechanism is mounted on the sofa.
Figure 9:
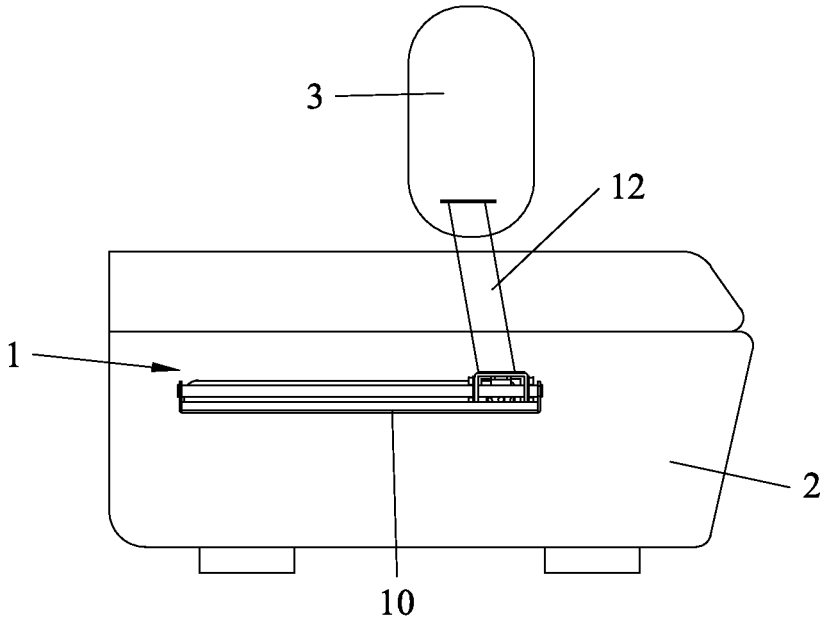
FIG. 9 is another status schematic view illustrating that the backrest translation mechanism is mounted on the sofa.

As shown in FIGS. 8 and 9, the holder 10 of the backrest translation mechanism 1 according to the present invention is mounted on the sofa seat 2, and the backrest mount 12 is mounted on the backrest 3 of the sofa. The position of the backrest 3 can be adjusted by the backrest translation mechanism 1, so that the sofa has multiple using positions.

In comparison with the prior art, since the backrest 3 is mounted on the upper end of the backrest mount 12, and the holder 10 fixed on the sofa seat 2 is mounted on the lower end of the backrest mount 12, thus the backrest 3 is capable of translating or move horizontally along the length direction when the backrest 3 is adjusted, which the operation is very simple. Furthermore, the weight of the backrest 3 is sustained by the sofa seat 2 during the translation movement, but not by the backrest translation mechanism 1, which prevents the backrest translation mechanism 1 being damaged. Meanwhile, due to multiple locking slots 112 are set on the swing locating member 11, thus the backrest mount 12 could be locked in different positions by engagement between the positioning pin 15 and the locking slots 112, that is the backrest 3 has multiple using positions which meets different demands of consumers.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A backrest translation mechanism, used for adjusting positions of a backrest relative to a sofa seat, comprising a holder, a swing locating member, a backrest mount, a slider, and a positioning pin;

wherein the holder is mounted on the sofa seat;

wherein the swing locating member is shaped as a strip whose one end is defined as a first end pivoted on the holder, the swing locating member has several locking slots with downward openings arranged at regular intervals along a length direction of the swing locating member for engaging with and unidirectionally locking up the positioning pin by gravity, and one side of the locking slot that is far from the first end is provided with an inclined surface which is inclined from top to bottom and towards an opposite direction of the first end;

wherein the backrest mount has an upper end mounted on the backrest and a lower end slidably set on the holder along the length direction;

wherein the slider is slidably set on the swing locating member along the length direction, and the slider has a retaining slot and a limiting slot both of which extends along the length direction and penetrates through the slider; the positioning pin is accepted by the retaining slot and the locking slot jointly, the limiting slot is located on one side of the retaining slot that closes to the first end and communicated with the retaining slot, and the positioning pin is restricted to be out of the locking slot by the limiting slot;

wherein the positioning pin is fixed on the lower end of the backrest mount and slidably inserted into the retaining slot and the limiting slot;

wherein the retaining slot and the limiting slot have a common lower wall, and an upper wall of the retaining slot is higher than that of the limiting slot, thus forming a lying L shape;

wherein in assembly the upper wall of the limiting slot is lower than a position of the opening of the locking slot, and the upper wall of the retaining slot is higher than the position of the opening of the locking slot;

wherein while moving the backrest mount along with the positioning pin toward the opposite direction of the first end, the positioning pin is contained in the retaining slot, once met by the positioning pin, the locking slot rotates down to contain the positioning pin and thereby locking up the positioning pin, and at this point the positioning pin is close to the upper wall; and wherein while the positioning pin is being moved out of any one of the locking slots along the inclined surface to the interval, the positioning pin is moved to close to the common lower wall, and the swing locating member together with the slider rotate upward, and at this point the backrest mount along with the positioning pin is allowed to move toward the first end, and the positioning pin is slid into the limiting slot which restricts the locking slot to lock the positioning pin.

2. The backrest translation mechanism according to claim 1, wherein a long groove is formed through the swing locating member along the length direction and adapted for slidably receiving the positioning pin, and the locking slots are formed on an upper wall of the long groove.

3. The backrest translation mechanism according to claim 1, wherein each locking slot has a cambered surface at one side that closes to the first end, and the cambered surface is abutting on the inclined surface and has a shape corresponding with an external profile of the positioning pin.

4. The backrest translation mechanism according to claim 1, wherein a spring leaf is set between the swing locating member and the slider, which is outwards urging on the slider.

5. The backrest translation mechanism according to claim 1, wherein the holder comprises at least one guide roller, and at least one sleeve is formed at the lower end of the backrest mount for allowing the guide roller to pass through.

6. The backrest translation mechanism according to claim 5, wherein two limiting plates standing vertically are provided at two sides of the holder, and the guide roller is set between the limiting plates.

7. The backrest translation mechanism according to claim 5, wherein two guide rollers are provided at two sides of the holder respectively, and the guide rollers are symmetrical with the swing locating member.

8. The backrest translation mechanism according to claim 7, wherein the lower end of the backrest mount is a provided with a sliding mount, two sides of the sliding mount are provided with two sleeves, and a middle of the sliding mount is provided with an opening for allowing the swing locating member and the slider to pass through.

9. The backrest translation mechanism according to claim 8, wherein two pin fasteners extending downwards are fixed on a bottom of the sliding mount, which are located at two sides of the slider and form a passageway for allowing the positioning pin to pass through and then connect firmly.

* * * * *